US006315476B2

(12) United States Patent
Nakagawa

(10) Patent No.: US 6,315,476 B2
(45) Date of Patent: Nov. 13, 2001

(54) WRITING IMPLEMENT

(75) Inventor: Satoshi Nakagawa, Minato-ku (JP)

(73) Assignee: Tripod Design Co., Ltd., Tokyo (JP)

( * ) Notice: Subject to any disclaimer, the term of this patent is extended or adjusted under 35 U.S.C. 154(b) by 0 days.

(21) Appl. No.: 09/428,081

(22) Filed: Oct. 27, 1999

(30) Foreign Application Priority Data

Oct. 29, 1998 (JP) ..... 10-008548

(51) Int. Cl.[7] ..... A46B 5/02
(52) U.S. Cl. ..... 401/6
(58) Field of Search ..... 401/6, 7, 88; 15/443

(56) References Cited

U.S. PATENT DOCUMENTS

| | | | | |
|---|---|---|---|---|
| D. 359,508 | * | 6/1995 | Debbas | D19/47 |
| 3,338,217 | | 8/1967 | Harrison . | |
| 5,470,162 | | 11/1995 | Rubin . | |
| 5,626,430 | | 5/1997 | Bistrack . | |
| 5,785,443 | | 7/1998 | Rubin . | |

FOREIGN PATENT DOCUMENTS

| | | |
|---|---|---|
| 315547 | 11/1919 | (DE) . |
| 1 340 389 | 12/1973 | (GB) . |
| SHO 56-140486 | 10/1981 | (JP) . |
| HEI 4-22289 | 2/1992 | (JP) . |
| WO 94/00305 | 1/1994 | (WO) . |

* cited by examiner

*Primary Examiner*—Gregory L. Huson
*Assistant Examiner*—Peter deVore
(74) *Attorney, Agent, or Firm*—Oliff & Berridge, PLC.

(57) ABSTRACT

A writing implement suitable to be used by those with handicap in their hands and/or finger(s) comprising a grip having a terminal end having a curved surface adapted to contact with the palm of a user, the grip being formed such that the grip is held with the fingers and the palm in such a way that the grip is wrapped by the hand; and a pen point extending from a front end of the grip with a given angle. The grip can optionally have one or more concave contours adapted to fit the finger(s) of the user, wherein each concave contour can fit one or more fingers.

20 Claims, 3 Drawing Sheets

11
11b
11a
12
13
14

11
11a
12
14
14
14
11b 14
11
12
14

12
11
11b
11a
14
14

11
11b
14
11a
12
14

11
11b
15
11a
12

11
11a
12
15
11b 11
15
12

11
5

12
15
11
11a
14
11b 11
15
11a
12
11b
15

WRITING IMPLEMENT

This application is based on Utility Model Application No. 10-008,548 (1998) filed Oct. 29, 1998 in Japan, the content of which is incorporated hereinto by reference.

BACKGROUND OF THE INVENTION

1. Field of the Invention

The present invention relates to a writing implement such as a ballpoint pen, a mechanical pencil, and a fountain pen. More particularly, the present invention relates to a writing implement that is suitable to be used by those with handicap in their hand and/or finger(s).

2. Description of the Related Art

Writing implements that are generally used are rodlike. These conventional writing implements are to be held by three fingers, or the thumb, the index finger, and the middle finger, when used. However, the conventional writing implement will move above through the root between the thumb and the index finger when the pen point is pushed to the paper surface when the implement is used by a user with a weak grip. Therefore, the conventional writing implement is extremely difficult to use for those with handicap in their hand and/or finger(s).

SUMMARY OF THE INVENTION

It is an object of the present invention to provide a writing implement that is suitable to be used by those with handicap in their hand and/or finger(s).

The above object and others are accomplished by providing a writing implement which has a grip having a terminal end having a curved surface adapted to contact with the palm of a user, the grip being formed such that the grip is held with the fingers and the palm in such a way that the grip is wrapped by the hand, and a pen point extending from a front end of the grip with a given angle. The grip can optionally have one or more concave contours adapted to fit the finger(s) of the user, wherein each concave contour can fit one or more fingers.

BRIEF DESCRIPTION OF THE DRAWINGS

Embodiments of the present invention will now be described with reference to the accompanying drawings, in which.

DETAILED DESCRIPTION OF PREFERRED EMBODIMENTS

Referring now to FIGS. 1A–1E, the writing implement of this embodiment has a grip 11 having a curved surface formed such that the grip 11 is held with the fingers and the palm in such a way that the grip 11 is wrapped by the hand. The grip 11 shows a pear-like shape in the plan view in FIG. 1E and the bottom view in FIG. 1D. The grip 11 shows a comb-like shape in the side views in FIGS. 1A and 1B. The grip 11 has an oval shape that extends in the direction from the front end 11*a* to the terminal end 11*b* wherein the grip 11 is formed such that the front end 11*a* is narrower than the terminal end 11*b*.

The terminal end 11*b* of the grip 11 has a curved bulbous surface adapted to contact with the palm. A pen point 12 extends out from a front end 11*a* of the grip with a given angle. The pen point 12 can be a pen point of, for example, a ballpoint pen, a mechanical pencil, and a fountain pen. The grip 11 houses a member 13 to store, for example, ink (in the case of a ballpoint pen or a fountain pen) or leads (in the case of mechanical pencil) as indicated by a dashed line in FIG. 1A.

Figures 1A, 1B, 1C, 1D, 1E:
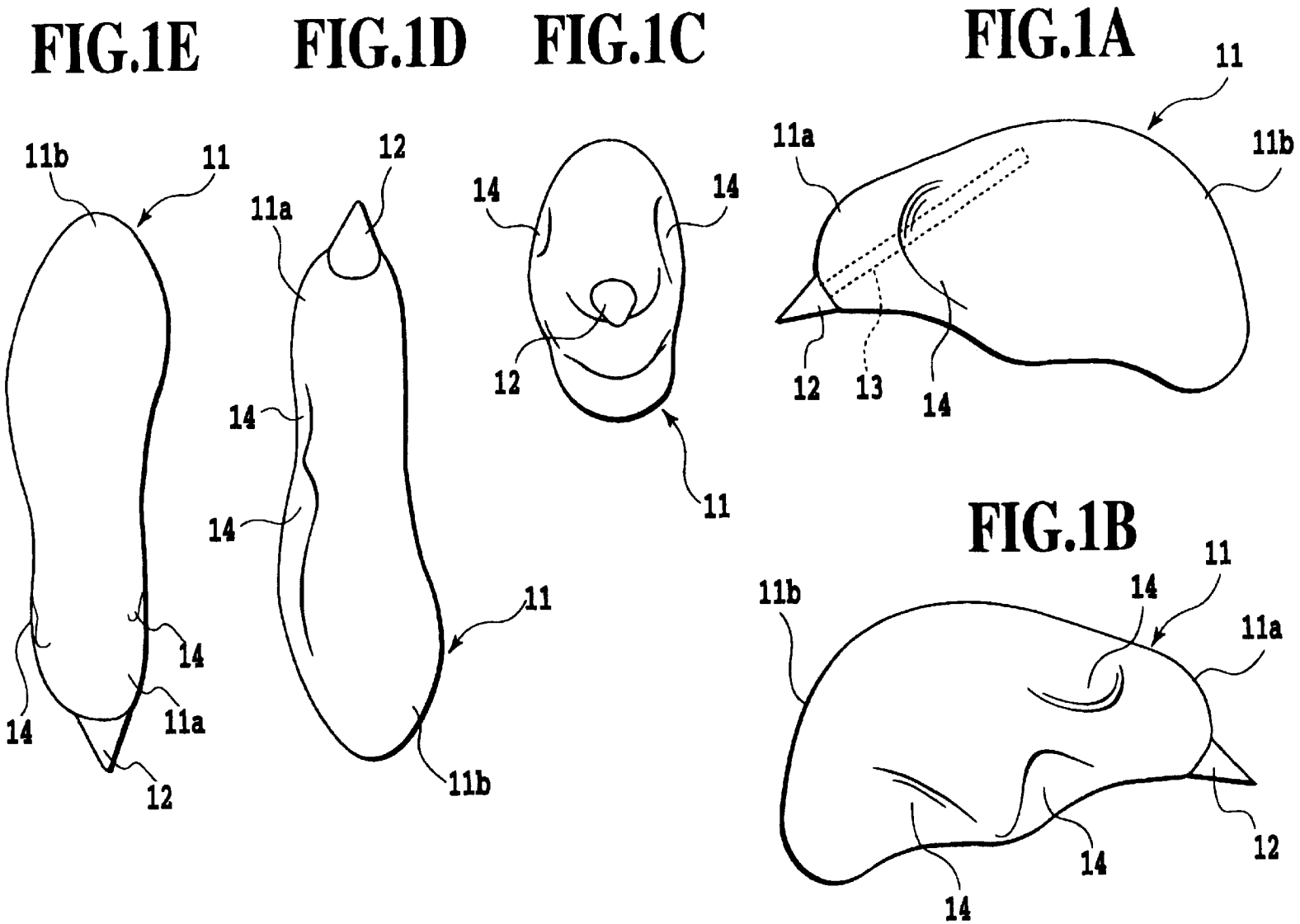
FIG. 1A shows a right side view of a writing implement of an embodiment of the present invention.
FIG. 1B shows a left side view of the writing implement of FIG. 1A.
FIG. 1C shows a front view of the writing implement of FIG. 1A.
FIG. 1D shows a bottom view of the writing implement of FIG. 1A.
FIG. 1E shows a plan view of the writing implement of FIG. 1A.
Figure 2:
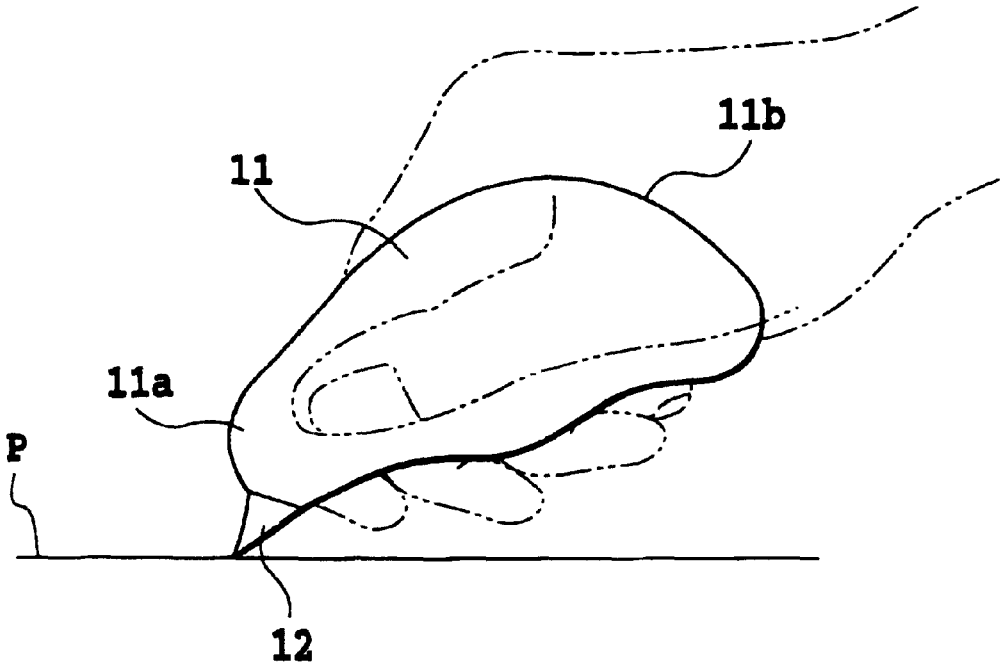
FIG. 2 shows the writing implement of FIG. 1A as held in a hand.
Figures 3A, 3B, 3C, 3D, 3E, 3F:
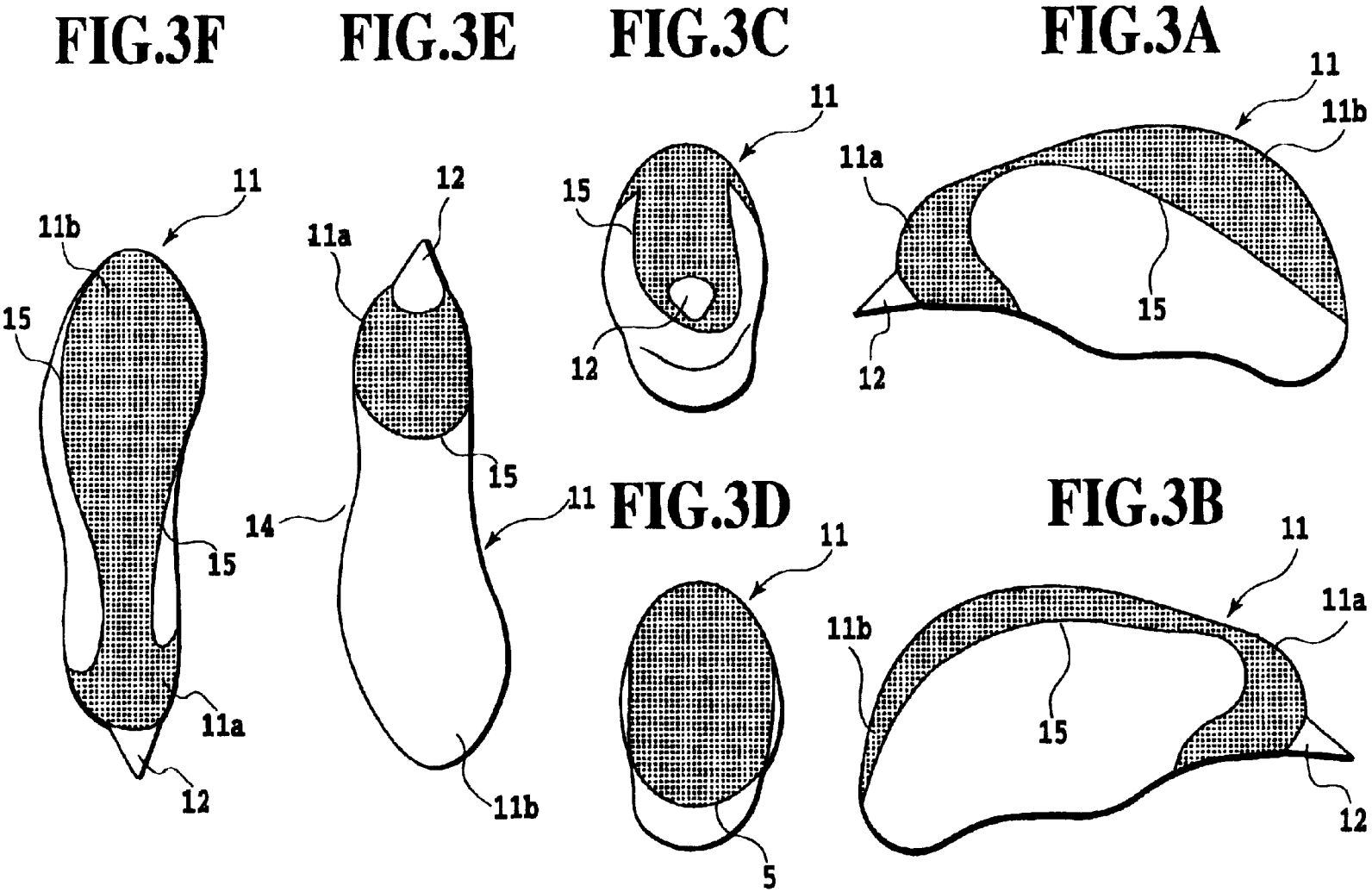
FIG. 3A shows a right side view of a writing implement of another embodiment of the present invention.
FIG. 3B shows a left side view of the writing implement of FIG. 3A.
FIG. 3C shows a front view of the writing implement of FIG. 3A.
FIG. 3D shows a rear elevation of the writing implement of FIG. 3A.
FIG. 3E shows a bottom view of the writing implement of FIG. 3A.
FIG. 3F shows a plan view of the writing implement of FIG. 3A.

When the writing implement described above is used, the implement is hold in such a way that the terminal end 11*b* contacts with the palm, that the thumb and the index fingers pinches the front end 11*a* or an area near it, and that the middle finger, the ring finger, and the little finger wraps the bottom side, as shown in FIG. 2. The implement is supported by not only fingers but also the palm when used. Therefore, in order to make the implement handy for those with handicap in their hand and/or finger(s), the pen point 12 should form a certain angle with the grip 11.

The writing implement described above is particularly suitable to be used by those with handicap in their hand and/or finger(s). The term "handicap" refers to any kind of problem that spoils dexterity at conventional writing implement. Therefore, the handicap can be congenital or acquired and the acquired handicap can be temporal or permanent. For example, those who has an injury to their fingers or those who has a congenital defect in their fingers can be called "those with handicap in their hand and/or finger(s)".

It will be appreciated by those skilled in the art that this implement can be used by those without one or more fingers because the implement is supported by not only fingers but also the palm. It will also be appreciated by those skilled in the art that this implement can be used by those children who do not yet have a strong grip enough to hold the conventional writing implement.

The grip 11 can optionally have one or more concave contours 14 adapt to fit the finger(s) of the user, wherein each concave contour can fit one or more fingers. This will allow the user to hold the implement even more firmly and stably. FIGS. 1A–1E show the grip 11 which has 4 concave contours, one adapted to fit the thumb, another adapted to fit the index finger, a third adapted to fit the middle finger, and the other adapted to fit both of the ring finger and the little finger. It will be appreciated by those skilled in the art that depending upon the particular application, the numbers of concave contours and the numbers of fingers each concave contour is to fit can be decided. For example, the grip can have only two concave contours adapted to fit the thumb and the index finger, respectively, or the grip can have five concave contours adapted to fit all the five fingers, respectively.

The grip can be colored in different colors such that those who also have bad eyesight can hold the grip with ease. For example, as shown in FIGS. 3A–3F, by coloring in one color a surface of the grip on which the finger will touch the grip when the implement is used and by coloring in a different color the rest of the surface, those with a weak grip as well as bad eyesight can hold the grip with ease.

Thus, the present invention will accomplish the object to provide a writing implement that is suitable to be used by those with handicap in their hand and/or finger(s).

The terms and expressions which have been employed are used as terms and expressions of description and not of limitation, and there is no intention in the use of such terms and expressions of excluding any equivalent of the features shown and described, but it is recognized that various modifications are possible within the scope of the appended claims.

What is claimed is:

1. A writing implement comprising a pen point and a grip, the grip having a smoothly curving surface as a whole;

the grip comprising a front surface, a rear surface, a bottom surface, and first and second opposed side surfaces, the rear surface extending rearward from the front surface, the side surfaces extending upward from the bottom surface and downward from the rear surface, the rear surface having a terminal end configured to fit the palm of a user, the bottom surface configured to engage at least one of the middle finger, ring finger, and the little finger of the user;

the grip being so configured that when the implement is in use, the portion of the implement which is farthest from the pen point is within the palm of the user; and the pen point extending from the front surface.

2. The writing implement of claim 1, wherein the grip is so configured that when the implement is in use, the thumb, the index finger, and the middle finger of the user are positioned closer to the point than the ring finger and the little finger of the user.

3. The writing implement of claim 2, wherein a substantial portion of the side surfaces and the bottom surface is colored in one color and a substantial portion of the front surface and the rear surface is colored in another color.

4. The writing implement of claim 2, wherein the writing implement has a bird-like form.

5. The writing implement of claim 2, wherein, when in use, the writing implement is configured such that a terminal end is positioned lower that a virtual extension line which is drawn from the pen point perpendicular to the front surface of the writing implement.

6. The writing implement of claim 2, wherein, when in use, the writing implement is configured such that all five fingertips of a user come in contact with the writing implement.

7. The writing implement of claim 1, wherein the first and the second opposed side surfaces are provided with opposed concave contours, the concave contours being smoothly joined to the rest of the side surfaces, the concave contour of one side surface being configured to engage the thumb of the user, the concave contour of the other side surface being configured to engage the index finger of the user.

8. The writing implement of claim 7, wherein a substantial portion of the side surfaces and the bottom surface is colored in one color and a substantial portion of the front surface and the rear surface is colored in another color.

9. The writing implement of claim 7, wherein the writing implement has a bird-like form.

10. The writing implement of claim 7, wherein, when in use, the writing implement is configured such that a terminal end is positioned lower that a virtual extension line which is drawn from the pen point perpendicular to the front surface of the writing implement.

11. The writing implement of claim 7, wherein, when in use, the writing implement is configured such that all five fingertips of a user come in contact with the writing implement.

12. The writing implement of claim 1, wherein the grip is so configured that when the implement is in use, the thumb, the index finger, and the middle finger of the user are positioned closer to the pen point than the ring finger and the little finger of the user, and the first and second opposed side surfaces are provided with opposed concave contours, the concave contours being smoothly joined to the rest of the side surfaces, the concave contour of one side surface being configured to engage the thumb of the user, the concave contour of the other side surface being configured to engage the index finger of the user.

13. The writing implement of claim 12, wherein a substantial portion of the side surfaces and the bottom surface is colored in one color and a substantial portion of the front surface and the rear surface is colored in another color.

14. The writing implement of claim 12, wherein the writing implement has a bird-like form.

15. The writing implement of claim 12, wherein, when in use, the writing implement is configured such that a terminal end is positioned lower that a virtual extension line which is drawn from the pen point perpendicular to the front surface of the writing implement.

16. The writing implement of claim 12, wherein, when in use, the writing implement is configured such that all five fingertips of a user come in contact with the writing implement.

17. The writing implement of claim 1, wherein a substantial portion of the side surfaces and the bottom surface is colored in one color and a substantial portion of the front surface and the rear surface is colored in another color.

18. The writing implement of claim 1, wherein the writing implement has a bird-like form.

19. The writing implement of claim 1, wherein, when in use, the writing implement is configured such that a terminal end is positioned lower that a virtual extension line which is drawn from the pen point perpendicular to the front surface of the writing implement.

20. The writing implement of claim 1, wherein, when in use, the writing implement is configured such that all five fingertips of a user come in contact with the writing implement.

* * * * *